US005110357A

United States Patent [19]

Kuwano et al.

[11] Patent Number: 5,110,357

[45] Date of Patent: May 5, 1992

[54] NONSILICA MOLD MATERIAL FOR DENTAL TITANIUM CAST

[75] Inventors: Akira Kuwano, Tokyo; Yoshimasa Kidowaki, Osaka, both of Japan

[73] Assignee: Iwatani Sangyo Kabushiki Kaisha (Iwatani International Corp.), Osaka, Japan

[21] Appl. No.: 562,662

[22] Filed: Aug. 3, 1990

[30] Foreign Application Priority Data

Dec. 19, 1989 [JP] Japan ..... 1-329207

[51] Int. Cl.[5] ..... C09K 3/00; C04B 35/00; C03C 10/00; C03C 10/16

[52] U.S. Cl. ..... 106/35; 106/38.51; 501/1; 501/2; 501/3; 501/5; 501/7; 501/10

[58] Field of Search ..... 106/35, 38.5; 501/1, 501/2, 3, 5, 7, 10

[56] References Cited

U.S. PATENT DOCUMENTS

| | | | |
|---|---|---|---|
| 4,814,011 | 3/1989 | Kamohara et al. | 106/35 |
| 4,909,847 | 3/1990 | Ohi et al. | 106/35 |
| 4,911,749 | 3/1990 | Ohi et al. | 106/35 |

*Primary Examiner*—A. Lionel Clingman
*Assistant Examiner*—William S. Parks
*Attorney, Agent, or Firm*—Bacon & Thomas

[57] ABSTRACT

In a mold material for use in molding a titanium cast to be mounted into the mouth as a dental prosthesis, magnesia and phosphate are added as a binder to its main ingredient composed of alumina and zirconia.

8 Claims, No Drawings

NONSILICA MOLD MATERIAL FOR DENTAL TITANIUM CAST

BACKGROUND OF THE INVENTION

1. Field of the Invention

The present invention relates to a mold material for use in molding a titanium cast to be mounted into the mouth as a dental prosthesis.

2. Description of the Prior Art

Generally, the titanium is light in weight and superior in corrosion resistance and also in biocompatibility. But it has drawbacks such as tendencies to be easily oxidized at a high temperature as well as to be easily contaminated within a crucible and within a mold. Therefore, in recent years there have been proposed several kinds of mold materials for use in casting the pure titanium or titanium alloys.

As a mold material for use in molding a dental titanium cast, so far have been made known a material having magnesia for its main ingredient, a material having zirconia for its main ingredient, a material having calcia for its main ingredient and the like by a scientific essay or a scientific lecture.

Generally, the dental cast is formed as a thin cast which is not more than several millimeters in thickness and is often ground by a dentist for a fine adjustment in order to fit the cast in the mouth. Therefore, in case that there exist inner blowholes in the cast, the blowholes appear in the external surface of the cast due to such grinding. Accordingly, it is required to mold the dental cast having no defects and also to provide a smooth external surface for the cast.

Further, since the dental cast is mounted into the mouth, the cast often comes into contact with the mucosa of the mouth having the sharp sense of touch. Therefore, the feeling of mounting is greatly affected by a surface roughness of the cast. In case that there exist the surface defects and the inner blowholes appeared in the external surface of the dental cast by the grinding, the cast is accompanied with its own proper problem that the surface defects or the defect portions appearing in the surface tend to easily provide a nest for the propagation of bacteria, which problem is not found in any other casting.

Furthermore, also an adaptability of a cast for its mold, namely a high dimensional accuracy is required for the dental cast.

But, in a conventional mold material for casting the titanium there are several practical problems that a sintering is caused between the titanium and the mold material to provide a sintering of casting surface, casting defects such as blowholes are produced and a size of the cast is reduced. Resultantly, the yield rate and the quality of the cast become worse and the cost of the titanium cast becomes higher. So far there has not been provided such a mold material as enabling to solve such proper problems of the dental cast.

In the mold material having the magnesia for its main ingredient, there are practical problems that it takes a long time for curing, the fresh mold before sintering is weak in strength and so on. In the mold made of the material having the zirconia for its main ingredient, an agar-agar usually used as an impression material doesn't cure, but only a special impression material such as a silicon rubber and a vinyl silicone can cure. Thereupon, there are also several practical problems that it takes a long time for curing, both the fresh mold and the sintered mold are weak in strength, a ringless casting is impossible, a shrinkage during the curing is large, a special ring is needed for casting and the cost is increased by use of the expensive zirconia as the main ingredient. In the mold material having the calcia as its main ingredient, there are several practical problems that a special preserving method, for example a vacuum wrapping is required for the mold because the calcia is hygroscopic and water-absorptive, a strong smell of methanol makes the working environment and hygiene worse because the calcia mold material can not be kneaded well with the water and should be kneaded with the methanol and the cast can not be made with a high dimensional accuracy because the calcia is subject to a curing shrinkage and is lack of expansivity.

SUMMARY OF THE INVENTION

It is an object of the present invention to provide a mold material which is not reactive completely with the melt titanium and capable of molding a dental titanium cast with a high dimensional accuracy and of providing a smooth external surface for the cast.

It is another object of the present invention to provide a mold material which is good in workability.

For accomplishing the above-mentioned objects, the present invention is characterized in that a nonsilica mold material for a dental titanium cast has alumina and zirconia for its main ingredient and has magnesia and phosphate added as a binder. It is more preferable that the alumina being 15~25 μm in mean particle size and the zirconia being 25~35 μm in mean particle size are used and the magnesia and the phosphate as the binder are added to the main ingredient so as to be in the amount of 15~25 percent.

According to the present invention, since the mold material has the alumina and the zirconia for its main ingredient and has the magnesia and the phosphate added as the binder, it can be kneaded only with the water, doesn't require a special procedure for making an investment slurry and can provide a well workable mold material.

When a casting mold is formed from this mold material by the same way as the conventional one, it is possible to make the surface of a molding cavity smooth when the mold is sintered so as to improve the releasability between the cast and the mold, to make the cast surface smooth and to improve the dimensional accuracy of the cast with lessening its shrinkage. Thereby, the mold material according to the present invention provides a most suitable mold material for the dental cast to be mounted into the mouth.

Further, since the alumina, the zirconia and the magnesia contained in the mold material are reflactories which can be comparatively readily obtained and stable at a high temperature and they don't contain silica which readily reacts with the titanium, it becomes possible to prevent an oxidation of the titanium at the time of casting and to prevent an oxidation contamination of the cast when within an inert gas environment the titanium is cast in the mold made of such mold material. Thereby, the practically useful mold material for the dental titanium cast can be provided.

DESCRIPTION OF THE PREFERRED EMBODIMENTS

Now, embodiments of the present invention will be explained in detail hereinafter.

FIRST EMBODIMENT

An investment material is provided by adding metal oxide in the amount of 5 percent including boron trioxide, magnesia in the amount of 10 percent and ammonium dihydrogenphosphate in the amount of 8 percent as a binder to alumina being 15 μm in mean particle size (800-mesh) in an amount of 57 percent and zirconia being 25 μm (600-mesh) in the amount of 20 percent. Then, an investment slurry material is provided by means of a water adding in the amount of 23 cc relative to the investment material in the amount of 100 g and a vacuum kneading.

A casting model is formed by use of a plate-shaped wax being 0.5 mm in thickness and a clasp wax, and then a mold is formed by use of the above investment slurry material according to a known investment casting. After removal of the wax, the mold is sintered at 1200° C. and then it is set to a pressure casting machine employing an inert gas to mold the titanium cast.

As a result, it is possible to provide the cast having a smooth casting surface and a high dimensional accuracy. Further, as a result of a X-ray scanning, the cast proves to have no casting defects such as inner blowholes.

SECOND EMBODIMENT

An investment material is provided by adding the magnesia in the amount of 13 percent and the ammonium dihydrogenphosphate in the amount of 8 percent as the binder to the alumina being 15 μm in means particle size (800-mesh) in the amount of 59 percent and the zirconia being 25 μm in means particle size (600-mesh) in the amount of 20 percent. Then, the investment slurry material is provided by adding a water in the amount of 23 cc relative to the above investment material in the amount of 100 g and by a vacuum kneading.

The titanium is cast by use of the same casting model and the same casting machine as those used in the first embodiment.

As a result, it is possible to provide the cast having no casting defects similarly to the first embodiment. Incidentally, the mold of this embodiment rarely suffered cracks at the time of sintering, but such cracks proved to provide no practical problems.

THIRD EMBODIMENT

An investment material is provided by adding metal oxide in the amount of 5 percent including boron trioxide, magnesia in the amount of 10 percent and ammonium dihydrogenphosphate in the amount of 8 percent as a binder to alumina being 25 μm in mean particle size (600-mesh) in the amount of 57 percent and zirconia being 35 μm in mean particle size (500-mesh) in the amount of 20 percent. Then, an investment slurry material is provided by adding a water in the amount of 23 cc relative to the above investment material in the amount of 100 g and by a vacuum kneading.

The titanium is cast by use of the same casting model and the same casting machine as those used in the first embodiment.

As a result, it is possible to provide the cast having no casting defects similarly to the first embodiment.

FIRST COMPARATIVE EXAMPLE

When the titanium is cast on the understanding that alumina being 43 μm coarser than 25 μm in mean particle size is used for the mold and the other conditions are made the same as those of the first embodiment, the mold material becomes apt to be sintered onto the surface of the cast article so that sintering of casting surface is found in the cast article. Since such sintering of the mold material is caused by the reaction between the molten metal for casting and the mold material, it is supposed that deep intrusions of the molten metal on the surface of the mold cause the sintering when the concavo-convex state of the surface of the mold material becomes conspicuous.

Incidentally, the particle size of the alumina may be made finer than 15 μm. But, in this case, since it becomes difficult to knead the mold material with a water and then to carry out the investment procedure and further the cost of such alumina becomes excessively high, the practicability thereof is lost.

SECOND COMPARATIVE EXAMPLE

The molten titanium is cast by use of the mold materials provided by gradually increasing the compounding ratio of alumina from 57% and increasing the compounding ratio of zirconia therewith and under the same casting condition. As a result, when the compounding ratio of alumina exceeds 70%, the curing time of the investment slurry material becomes too short to carry out the investment working and the mold surface becomes powdery to interfere with subsequent workings. Further, a strength of the sintered mold is so lowered to be scarcely fit for use in the pressure casting machine employing an inert gas.

THIRD COMPARATIVE EXAMPLE

The molten titanium is cast by use of the mold materials provided by gradually decreasing the compounding ratio of alumina from 57% and increasing the compounding ratio of zirconia therewith and under the same casting condition. As a result, when the compounding ratio of alumina decreases below 50%, the mold is cracked at the time of sintering, the size of the cast is reduced so that the dimensional accuracy becomes worse and the production ratio of faulty casts becomes large. Further, since the consumed amount of expensive zirconia increases, accordingly the cost gets so higher to decrease the practicability.

FOURTH COMPARATIVE EXAMPLE

The molten titanium is cast by use of the mold materials provided by varying the compounding ratio of the binder relative to the refractory material composed of alumina and zirconia in the fixed compounding ratio 3:1 and under the same casting condition. As a result, with the mold material provided by adding the binder in the amount of 10% to the refractory material in the amount of 90%, the workability is good at the time of kneading, but a mold strength is not enough so that the mold often breaks during handling thereof. With the mold material provided by adding the binder in the amount of 15% to the refractory in the amount of 85%, the workability is good, a mold strength is a little weak but doesn't interfere with practical procedures and the quality of the cast is satisfactory. With the mold material provided by adding the binder in the amount of 20% to the refractory in the amount of 80%, both the workability at the time of kneading and the mold strength are satisfactory and also the quality of the cast is satisfactory. With the mold material provided by adding the binder in the amount of 25% to the refractory material in the amount of 75%, the curing time of the investment slurry material is a little short but doesn't interfere with the practical procedures and both the mold strength and the quality of the mold are satisfactory. With the mold material provided by adding the binder in the amount of 30% to the refractory material in the amount of 70%, the curing time of the investment slurry material is too short to carry out the investment working.

Having described specific preferred embodiments of the invention, it will be appreciated that the present invention is not limited to those specific embodiments, and that various changes and modifications can be effected therein by one of ordinary skill in the art without departing from the spirit or scope of the invention as defined by the appended claims.

What is claimed is:

1. A nonsilica mold material for a dental titanium case consisting essentially of:

a major amount of alumina and zirconia and a minor amount of magnesia and phosphate sufficient to act as a binder for the alumina and zirconia up to 5% boron trioxide as an optional binder ingredient.

2. A nonsilica mold material for a dental titanium cast as defined in claim 1, wherein the alumina being 15~25 μm in mean particle size and the zirconia being 25~35 μm in mean particle size are present.

3. A nonsilica mold material for a dental titanium cast as defined in claim 1 or claim 2, wherein the magnesia and the phosphate as the binder are added to the main ingredient so as to be in the amount of 15~25 percent.

4. The composition of claim 3 wherein the alumina is present in an amount about 50–70%.

5. The composition of claim 1 which further includes 5% boron trioxide.

6. A nonsilica mold material for a dental titanium cast which consists essentially of a major amount of alumina and zirconia and a minor amount of magnesia and phosphate sufficient to act as a binder for the alumina and zirconia.

7. The composition of claim 6 wherein the alumina has a mean particle size of 15~25 μm and the zirconia has a mean particle size of 25~35 μm.

8. The composition of claims 6 or 7 wherein the magnesia and phosphate binder is in an amount of 15–25%.

* * * * *